US005770308A

United States Patent [19]

Suzuki et al.

[11] Patent Number: 5,770,308

[45] Date of Patent: Jun. 23, 1998

[54] HIGH WATER-REPELLENT FIBER AND NONWOVEN

[75] Inventors: Masayasu Suzuki, Yasu-gun; Masaru Nishijima; Hirokazu Terada, both of Moriyama, all of Japan

[73] Assignee: Chisso Corporation, Tokyo, Japan

[21] Appl. No.: 822,689

[22] Filed: Mar. 24, 1997

[30] Foreign Application Priority Data

| | | | |
|---|---|---|---|
| Mar. 26, 1996 | [JP] | Japan | 8-096055 |
| May 27, 1996 | [JP] | Japan | 8-156095 |
| Jul. 15, 1996 | [JP] | Japan | 8-205187 |

[51] Int. Cl.[6] ..... D02G 3/00

[52] U.S. Cl. ..... 428/375; 428/378; 442/79

[58] Field of Search ..... 428/375, 378; 442/79, 82

[56] References Cited

U.S. PATENT DOCUMENTS

| | | | |
|---|---|---|---|
| 5,153,046 | 10/1992 | Murph | 428/378 |
| 5,183,589 | 2/1993 | Brunetta | 252/308 |
| 5,545,481 | 8/1996 | Harrington | 428/378 |
| 5,654,086 | 8/1997 | Nishijima et al. | 428/375 |

*Primary Examiner*—Newton Edwards
*Attorney, Agent, or Firm*—Wenderoth, Lind & Ponack

[57] ABSTRACT

A high water-repellent fiber comprising a thermoplastic resin, wherein the following components (A) 75–90% by weight, (B) 5–20% by weight and (C) 1–5% by weight are adhered on the fiber 0.1–1.0% by weight per fiber:

(A) a mixture comprising less than 55% by weight of at least one metal alkyl phosphate of 14–18 carbons, and 45% or more by weight of at least one metal alkyl phosphate of 20–24 carbons;

(B) a compound containing a perfluoroalkyl group; and (C) a metal alkyl phosphate of 2–6 carbons. The fiber has excellent antistatic properties and water repellency, no troubles of static electricity are found in the step for processing fibers into nonwovens, so that the resulting nonwovens can be preferably used for leakage-preventing materials or impermeable sheets of hygienic materials.

6 Claims, No Drawings

HIGH WATER-REPELLENT FIBER AND NONWOVEN

FIELD OF THE INVENTION

The present invention provides a water repellent fiber comprising a thermoplastic resin and having excellent antistatic properties, and a nonwoven made of the fiber. More particularly, it provides a water-repellent fiber and a nonwoven useful for leakage-preventing materials or impermeable sheets of disposable baby diapers and sanitary napkins.

DESCRIPTION OF THE PRIOR ART

The diapers broadly used in recent years have leakage-preventing means such as side gather and west gathers to prevent leakage of urine or a loose passage at the crotch sides or the abdominal side, and polyolefin film is applied on the reverse side of impermeable sheet. Sanitary napkins having side gathers to prevent leakage of menses are marketed.

In such materials for preventing side leakage or such an impermeable sheet, water repellency is required not to permeate urine or menses. Since the materials directly contact with the skin, these must have a good touch and little stimulation to the skin.

To satisfy these demands, many methods have been proposed and improved. As an example, a nonwoven is proposed in Japanese Patent Application Laid-open No. 4-316673. It is obtained by a method comprising opening the thermoplastic fibers, to which are applied polyethylene glycol oleate by using a card machine to obtain webs, and then processing the webs by using a heat emboss roll. Another nonwoven is proposed in Japanese Patent Application Laid-open No. 7-216737. It is obtained by a method comprising applying a surface modifier comprising potassium stearyl phosphate, potassium behenyl phosphate and paraffin wax to a polyolefin fiber or a polyester fiber, splitting the fiber by using a carding machine to obtain a web and processing the web by a suction dryer method, a heat roll method or the like.

In the production of spunbonded nonwovens made of hydrophobic materials such as polypropylene, polyester and the like, since it is unnecessary to use a surfactant and the nonwovens have excellent water repellency and mechanical strength, the use of the nonwovens has been increased.

However, by the method described in the above Laid-open No. 4-316673 and 7-216737, in which the fiber being applied a special surfactant or a surface modifier is used as raw materials and a web is formed by a card process and nonwoven is obtained by a heat process, it is not realized to obtain a fiber satisfying properties contrary to each other, namely antistatic properties for stabilized processing and water repellancy of functional nonwovens.

Although spunbonded nonwovens have excellent water repellancy, but these nonwovens have inferior uniformity and poor bulkiness. The surface is too fuzzy and irritating to the skin to obtain good feel.

An object of the present invention is to provide a water-repellent fiber and a nonwoven satisfying high water repellency and antistatic properties and having good feel.

SUMMARY OF THE INVENTION

The inventors of the present invention earnestly have studied to resolve the above mentioned problems and attained to the invention by adhering a special surfactant composition as a finish oil to the surface of fibers.

Namely, the present invention has the following constitution.

(1) A high water-repellent fiber being adhered 0.1–1.0% by weight of a composition comprising 75–90% by weight of the following component (A), 5–20% by weight of the following component (B) and 1–5% by weight of the following component (C):
  (A) a mixture comprising less than 55% by weight of at least one metal alkyl phosphate of 14–18 carbons, and 45% or more by weight of at least one metal alkyl phosphate of 20–24 carbons;
  (B) a compound containing a perfluoroalkyl group; and
  (C) a metal alkyl phosphate of 2–6 carbons.

(2) A high water-repellent fiber of (1), in which the thermoplastic resin is a polyolefin resin.

(3) A high water-repellent fiber of (1), in which the thermoplastic resin is a polyester resin. (4) A nonwoven made of the fiber described in any one of (1) to (3).

DETAILED DESCRIPTION OF THE INVENTION

The present invention is particularly described in the following.

The thermoplastic resins used as raw materials of high water-repellent fibers of the present invention includes, for example, polyolefin resins, polyester resins and polyamide resins. In these resins, the polyolefin resins and polyester resins having excellent hydrophobicity can be preferably used, because the resins have merits to provide the fibers having high water repellency of the object of the present invention.

Polyolefin resins include, for example, polyethylene, polypropylene, ethylene-vinyl acetate copolymer, ethylene-propylene copolymer, ethylene-propylene-butene-1-coplymer and the like. Polyester resins include, for example, polyethylene terephthalate, polybuthylene terephthalate, polyethylene terephthalate-isophthalate, polyether-polyester and the like.

Further, the high water-repellent fiber of the present invention can be obtained by selecting one or more kinds of the above thermoplastic resins and applying a melt spinning method. It is properly possible to mix additives such as pigments and antistatic agents within the limits of the objects of the present invention.

Component (A) constituting the surfactant composition used in the present invention is a mixture of metal alkyl phosphate (a) having 14–18 carbons and metal alkyl phosphate (b) having 20–24 carbons. To obtain high water-repellent fiber of the object of the present invention, in the weight ratio of (a) to (b), (b) must be 45% or more by weight. (a) and (b) are each one or more compounds, each compound is preferably a completely neutralized salt of mono and/or di-phosphates. The alkyl group of each compound may have side chains or unsaturated bonds, preferably a straight chain and a saturated bond in the balance of water-repellency with antistatic properties and the smoothness.

The metal alkyl phosphate is used with the object of giving water-repellency and smoothness to fibers. The carbon number of alkyl groups of less than 14 leads to low water-repellency, and the carbon number of more than 24 leads to an unpractical high cost.

Component (B) of the surfactant composition comprises a compound containing a perfluoroalkyl group. The compound having a very high water-repellency is a copolymer of an ethylene unsaturated monomer containing a perfluoroalkyl group and an ethylene unsaturated monomers. The ethylene unsaturated monomer containing a perfluoroalkyl group includes, for example, perfluoroalkyl acrylate and perfluoroalkyl methacrylate. The ethylene unsaturated monomer includes, for example, alkyl acrylate or alkyl methacrylate having a long chain alkyl group. Component (B) can be easily obtained by emulsifying a mixture of these monomers of 70:30–30:70 by weight ratio in the presence of a surfactant in water and copolymerizing the mixture in the presence of a catalyst such as an organic peroxide.

Component (C) of the surfactant composition comprises a metal alkyl phosphate having 2–6 carbons. The compound is obtained by phosphating an alcohol having 2–6 carbons and neutralizing the phosphate with alkali. Component (C) may be one or more compounds of metal alkyl phosphate. Each compound is preferably a completely neutralized salt of mono and/or di-phosphates. A compound having a polyoxy alkylene group, such as polyoxyethylene and polyoxypropylene, added to the above metallic alkyl phosphate may be used within the limits of the effect of the present invention.

Component (C) is not good to use as a primary ingredient because the component has little functional characteristics of smoothness. However, since the component has excellent antistatic properties, compositions having sufficient effect of antistatic are obtained by adding the component to the above components (A) and (B).

The reason why component (C) used as an antistatic agent has water-repellency in the present invention is considered that, since component (C) has very high hydrophilic nature, component (C) of fibers or the surface of nonwovens rapidly dissolves into water when it contacts with water, and since the surface activity of component (C) is relatively low, the surface tension of water is little lowered and the wetting of the surface of fiber is poor.

The surfactant composition used in the present invention comprises a mixture of the components (A), (B) and (C) described above, and the ratio of these components is (A):(B):(C)=75–90:5–20:1–5 by weight (100% by weight in total).

When the ratio of each component of the surfactant composition is beyond the limits of the above formulation ratio, the water repellency and antistatic properties become ill balanced and it becomes difficult to have merits of the present invention.

In the present invention, the finish oil comprising the above-mentioned components is applied to the fiber in the ratio of 0.1–1.0% by weight, preferably 0.2–0.8% by weight to the fiber weight. When the applying weight is less than 0.1% by weight, the antistatic properties are not improved. When the applying weight is beyond 1.0% by weight, it is undesirable because the finish oil easily peels off and soils the processing machine of nonwovens.

The method for applying the finish oil to the fiber is not limited, and a well-known method such as an oiling-roll method, a dipping method, a spraying method and the like can be used.

The nonwovens of the present invention can be obtained, by making the above-mentioned water repellent fibers into web having a desired basis weight by a card method or an air-lay method and by processing the web by a well-known method such as a needle punch method, a hot-melt adhering method or a heated roll method. When the nonwoven is used as a leakage-preventing materials or impermeable sheet of disposable baby diapers and sanitary napkins, the single yarn fineness of the water-repellent fiber of 0.5–10 deniers is preferable, and the basis weight of the nonwoven of 8–50g/m$^2$ is preferable.

In the above-mentioned nonwovens, if necessary, other fibers can be mixed with the water-repellent fibers of the present invention in the appropriate quantities.

DESCRIPTION OF THE PREFERRED EMBODIMENTS

The present invention is further illustrated but not limited by the following examples. The physical values in the examples are determined by the following methods.

Amount of adhesion of finish oil: Using a Soxhlet extractor, a short fiber sample log was extracted under reflux with a solvent mixed at methanol/petroleum ether (1/1 of a volume ratio) for three hours, and the solvent was removed to determine the weight (Wg) of the finish oil.

Adhesion ratio of finish oil agent (% by weight)

$$\text{Adhesion ratio of finish oil agent (\% by weight)} = \frac{W}{10} \times 10l$$

Antistatic properties: A short fiber sample 40 g was passed over a roller card machine under conditions of a relative humidity of 65% at a temperature of 20° C. to obtain a web, and the electrostatic voltage generated in the web was measured at the exit of the machine. When the voltage is 100V or less, the fiber can be practically used.

Water repellency: A test piece of 15 cm length and width was cut from a nonwoven sample, and the water-resistant pressure was determined at a up and down rate 10 cm/min according to the method of JIS L1092-A (a low water pressure method). It shows that, when the water-resistant pressure is higher, the water repellency is better and the water-resistant pressure of 60 mm or more can be practically used.

Feel: A test piece of 15 cm length and width was cut from a nonwoven sample, a organoleptic test is examined by five panelists and determined by the following standards.

o: All five persons feel that the touch is good.

Δ: One or two persons feel that the touch is not good.

x: Three or more persons feel that the touch is not good.

EXAMPLES 1–3 AND COMPARATIVE EXAMPLES 1–3

Conjugate fibers of a sheath and core type having conjugate volume ratio 50/50 that the core component was polypropylene and sheath component was polyethylene were spun into threads. After spinning, the threads were stretched to 4.2 times of the original length with a heat roll at a temperature of 110° C. In the stretching process, the threads were coated with finish oil No. 1–6 in Table 1 with an oiling roll, respectively.

The threads coated with finish oil No. 1–6 were crimped in a stuffing-box, dried and cut-off to obtain short fiber samples having 2d/f×51 mm. The short fiber samples were carded at a speed of 10 m/min with a roller carding machine to obtain webs having a basis weight of 20 g/m$^2$. The webs were then passed over an emboss roll having a bonding area of 24% at a temperature of 126° C., a linear pressure of 20 kg/cm and a speed of 10 m/min to obtain nonwovens.

The electrostatic voltage generated at carding, water repellency of nonwovens (resistance to water pressure) and feel of each sample were determined and the results are shown in Table 2.

COMPARATIVE EXAMPLE 4

Continuous filaments of polypropylene (single yarn denier: 2 d/f) were spun to form a web having a basis weight of 20 g/m$^2$. Then, by using an emboss roll having a bonding area of 15%, the web was processed under conditions of a speed of 10 m/min, a temperature of 133° C. and a linear pressure of 20 kg/cm to obtain nonwovens.

Water repellency (resistance to water pressure) and the feel of the resulting nonwoven were determined and the results are shown in Table 2.

TABLE 1

| Components (% by weight) | Finish oil No. | | | | | |
|---|---|---|---|---|---|---|
| Components in the present invention | 1 | 2 | 3 | 4 | 5 | 6 |
| A | | | | | | |
| Potassium cetyl phosphate | | 18 | 20 | | 40 | |
| Potassium stearyl phosphate | 45 | | 20 | 70 | | 70 |
| Potassium behenyl phosphate | 45 | 70 | 47 | 20 | | |
| B | | | | | | |
| *Compound containing a perfluoro group | 8 | 10 | 10 | 8 | | |
| C | | | | | | |
| Potassium butyl phosphate | 2 | 2 | 3 | 2 | | |
| Dimethyl silicone emulsion (MW = a million) | | | | | 60 | |
| Polyethylene wax emulsion (mp = 90° C.) | | | | | | 30 |

*Copolymer of β-perfluoroalkyl ($C_{9-13}$) ethyl acrylate and alkyl acrylate ($C_{16-18}$).

TABLE 2

| | Examples | | | Comparative examples | | | |
|---|---|---|---|---|---|---|---|
| | 1 | 2 | 3 | 1 | 2 | 3 | 4 |
| Finish oil No. | 1 | 2 | 3 | 4 | 5 | 6 | — |
| Adhesion ratio of finish oil (%) | 0.42 | 0.45 | 0.38 | 0.44 | 0.47 | 0.39 | — |
| Antistatic property (V) | 50 | 75 | 30 | 30 | 500 | 150 | — |

TABLE 2-continued

| | Examples | | | Comparative examples | | | |
|---|---|---|---|---|---|---|---|
| | 1 | 2 | 3 | 1 | 2 | 3 | 4 |
| Water-repellency (mm) | 70 | 75 | 68 | 53 | 65 | 38 | 75 |
| Feel | ○ | ○ | ○ | ○ | ○ | ○ | x |

In Examples 1–3, alkyl phosphates of 16, 18 and 22 carbons were used in component (A), and an alkyl phosphate of 4 carbons was used in component (C). The same merits as those of the above are obtained by using the other alkyl phosphates described in claim 1.

Since the high water-repellent fibers of the present invention have excellent antistatic properties and water repellency, no troubles of static electricity are found in the step for processing fibers into nonwovens, so that the resulting nonwovens can be preferably used for leakage-preventing materials or impermeable sheets of hygienic materials such as disposable baby diapers and sanitary napkins.

We claim:

1. A high water-repellent fiber comprising a thermoplastic resin, wherein the following components (A) 75–90% by weight, (B) 5–20% by weight and (C) 1–5% by weight are adhered on the fiber 0.1–1.0% by weight per fiber:

(A) a mixture comprising less than 55% by weight of at least one metal alkyl phosphate of 14–18 carbons, and 45% or more by weight of at least one metal alkyl phosphate of 20–24 carbons;

(B) a compound containing a perfluoroalkyl group; and (C) a metal alkyl phosphate of 2–6 carbons.

2. A high water-repellent fiber claimed in claim 1, wherein the thermoplastic resin is a polyolefin resin.

3. A high water-repellent fiber claimed in claim 1, wherein the thermoplastic resin is a polyester resin.

4. A nonwoven made of the fiber described in claim 1.

5. A nonwoven made of the fiber described in claim 2.

6. A nonwoven made of the fiber described in claim 3.

* * * * *